US010105740B2

(12) United States Patent
Hoffmeyer et al.

(10) Patent No.: US 10,105,740 B2
(45) Date of Patent: Oct. 23, 2018

(54) SANITARY ROTARY TANK CLEANING APPARATUS

(71) Applicant: Spraying Systems Co., Wheaton, IL (US)

(72) Inventors: Scott Hoffmeyer, Aurora, IL (US); Digna Naginevicius, Glendale Heights, IL (US)

(73) Assignee: Spraying Systems Co., Wheaton, IL (US)

( * ) Notice: Subject to any disclaimer, the term of this patent is extended or adjusted under 35 U.S.C. 154(b) by 20 days.

(21) Appl. No.: 15/342,894

(22) Filed: Nov. 3, 2016

(65) Prior Publication Data

US 2017/0120312 A1 May 4, 2017

Related U.S. Application Data

(60) Provisional application No. 62/250,067, filed on Nov. 3, 2015.

(51) Int. Cl.
*B05B 3/04* (2006.01)
*B08B 9/093* (2006.01)

(52) U.S. Cl.
CPC ..... *B08B 9/0936* (2013.01); *B05B 3/0422* (2013.01)

(58) Field of Classification Search
CPC ... B08B 9/0936; B05B 3/0422; B05B 3/0463; B05B 3/0468; B05B 3/0427; B05B 3/0445; B05B 13/0636
See application file for complete search history.

(56) References Cited

U.S. PATENT DOCUMENTS 2,208,813 A 7/1940 Ostling et al.
3,255,969 A * 6/1966 Saad ..... B05B 3/0445 239/227

(Continued)

FOREIGN PATENT DOCUMENTS

WO WO 96/37315 A 11/1996
WO WO 2015/063320 A1 5/2015
WO WO 2016/183404 A1 11/2016

OTHER PUBLICATIONS

International Search Report dated Mar. 24, 2017, in International Patent Application No. PCT/US2016/060377.

*Primary Examiner* — Darren W Gorman
*Assistant Examiner* — Steven M Cernoch
(74) *Attorney, Agent, or Firm* — Leydig, Voit & Mayer, Ltd.

(57) ABSTRACT

A rotary tank cleaning spray nozzle assembly which includes a stationary housing, a rotary housing for rotation about a central axis of the stationary housing, and a nozzle carrying hub supported by the rotary housing for rotation about an axis transverse to the axis of the stationary housing. A support rod extends through the rotary housing and into the stationary housing with a lower end supporting the underside of the rotary housing and the upper end being secured by a retainer. The retainer is releasable to permit removal of the rotary housing and nozzle hub from an underside of the stationary housing. A fluid driven drive for the rotary housing and nozzle hub includes a pair of removably mounted bevel gear rings. In one embodiment, liquid lubricating, frustoconical, high load carrying bearings support rotatably.

16 Claims, 6 Drawing Sheets

(56) References Cited

U.S. PATENT DOCUMENTS

| | | | | | |
|---|---|---|---|---|---|
| 3,326,468 | A * | 6/1967 | Bristow | B05B 3/0445 | 239/227 |
| 3,416,732 | A | 12/1968 | Reiter | | |
| 3,637,138 | A * | 1/1972 | Rucker | B05B 3/0445 | 239/227 |
| 3,902,670 | A * | 9/1975 | Koller | B05B 3/0445 | 239/227 |
| 4,214,705 | A * | 7/1980 | Watts | B05B 3/02 | 239/227 |
| 4,664,720 | A | 5/1987 | Rucker | | |
| 5,012,976 | A * | 5/1991 | Loberg | B05B 3/0445 | 239/227 |
| 5,092,523 | A * | 3/1992 | Rucker | B08B 9/0936 | 239/240 |
| 5,169,069 | A * | 12/1992 | Rucker | B05B 3/0445 | 239/227 |
| 5,954,271 | A * | 9/1999 | Le | B08B 9/0936 | 239/227 |
| 6,123,271 | A * | 9/2000 | Delaney | B05B 3/0445 | 239/227 |
| 6,561,199 | B2 * | 5/2003 | Gleeson | B05B 3/0445 | 134/167 R |
| 7,523,512 | B1 * | 4/2009 | Delaney | B05B 3/0445 | 4/662 |
| 7,942,157 | B2 * | 5/2011 | Lindros | B05B 3/0445 | 134/176 |
| 8,066,823 | B2 * | 11/2011 | Ross | B08B 9/0936 | 134/167 R |
| 8,137,481 | B2 * | 3/2012 | Jensen | B05B 3/06 | 134/167 R |
| 8,814,061 | B1 | 8/2014 | Delaney et al. | | |
| 2002/0179118 | A1 | 12/2002 | Gleeson et al. | | |
| 2011/0079254 | A1 | 4/2011 | Delaney et al. | | |

* cited by examiner

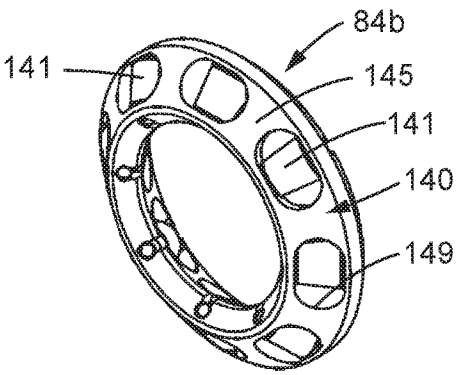
FIG.6
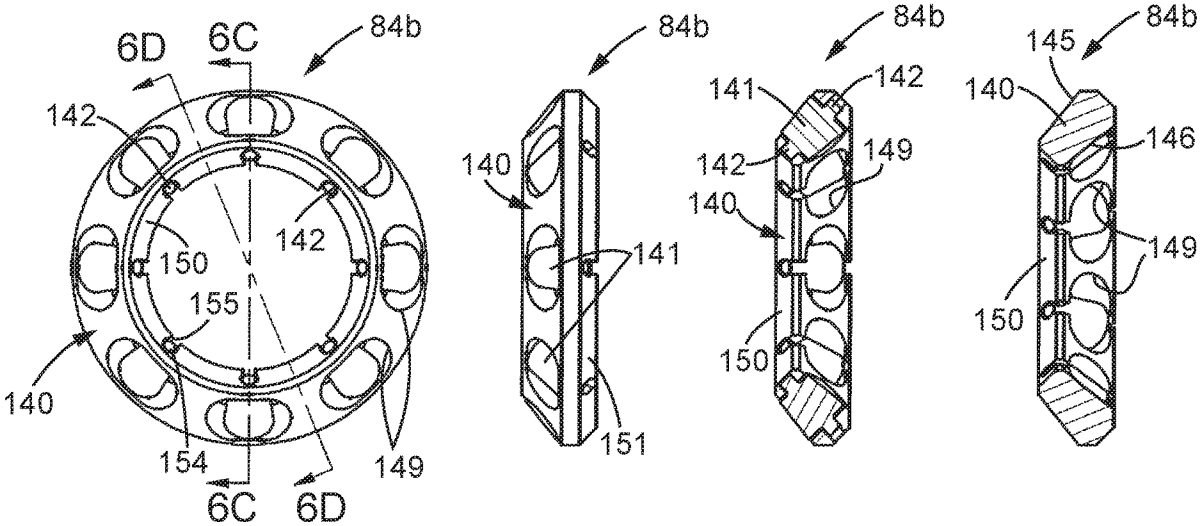
FIG.6D
FIG.6C
FIG.6B
FIG.6A

SANITARY ROTARY TANK CLEANING APPARATUS

CROSS-REFERENCE TO RELATED APPLICATIONS

This patent application claims the benefit of U.S. Patent Application No. 62/250,067, filed Nov. 3, 2015, which is incorporated by reference.

FIELD OF THE INVENTION

The present invention relates generally to rotary cleaning devices, and more particularly, to a multi-axis rotary tank cleaning spray nozzle assembly particularly adapted for use in sanitary environments, such as processing or storage tanks in the food, dairy, and pharmaceutical industries.

BACKGROUND OF THE INVENTION

Rotary tank cleaning spray nozzle assemblies require complex multi-directional drives for rotating the spray nozzles in a manner that ensures the discharging spray covers all areas of the tank. Such spray nozzle assemblies require numerous parts which can be cumbersome to assemble and disassemble for sanitary cleaning as required after each usage. Threaded components of the nozzle assembly can be particularly cumbersome to assemble and disassemble, and the threads of such connections must be reliably sealed from the processing fluids. Leakage of seals can cause contamination and bacteria to accumulate within the threads which can be difficult to clean to sanitary standards.

Such spray nozzle assemblies commonly have a vertically oriented stationary housing having a liquid inlet at an upper end, a rotary housing supported at a lower end for relative rotation about a central axis of the stationary housing, and a nozzle carrying hub supported radially outwardly of the rotary housing for rotation about an axis transverse to the axis of the stationary housing. The nozzle carrying hub typically is rotatably driven by bevel gearing between the stationary housing and the nozzle carrying hub which due to their angular interaction can be difficult to machine, service, and clean.

With the nozzle carrying hub acting as a radial extension of the rotary housing of such spray nozzle assemblies, during rotation of the rotary housing, load carrying bearings can incur relatively high stresses. This can cause wear, maintenance, failure, and costly replacement of bearings.

OBJECTS AND SUMMARY OF THE INVENTION

It is an object of the present invention to provide a rotary tank cleaning spray nozzle assembly which is adapted for quick and easy assembly and disassembly for facilitating frequent sanitary cleaning.

Another object is to provide a rotary tank cleaning spray nozzle assembly as characterized above which is easily assembled and disassembled by untrained personnel and the components of which lend themselves to thorough sanitary cleaning.

A further object is to provide a rotary tank cleaning spray nozzle assembly of the above kind in which the component parts of the assembly are free of threaded connections and associated seals for such threaded connections.

Another object is to provide such a rotary tank cleaning spray nozzle assembly having a bevel gear drive between a stationary housing and a nozzle carrying hub that lends itself to easier manufacture, repair or replacement, and cleaning.

Still another object is to provide a rotary tank cleaning spray nozzle assembly which minimizes excessive stresses load carrying bearings during operation of the spray nozzle assembly.

A further object is to provide a rotary tank cleaning spray nozzle assembly having load carrying bearings that are less susceptible to over stress wear, failure, and costly maintenance and replacement.

Yet another object is to provide a rotary tank cleaning spray nozzle assembly in which load carrying bearings relieve stress related wear and facilitate self cleaning of the bearings and spray nozzle assembly. A related object is to provide a spray nozzle assembly in which the load carrying bearings exhibit lower frictional resistance under loading.

A further object is to provide a rotary tank cleaning spray nozzle assembly having load carrying bearings that are easily assembled and disassembled for cleaning and maintenance.

Still another object is to provide a rotary tank cleaning spray nozzle assembly of such type that is relatively simple in construction and lends itself to economical manufacture.

Other objects and advantages of the invention will become apparent upon reading the following detailed description and upon reference to the drawings, in which:

BRIEF DESCRIPTION OF THE DRAWINGS

FIG. 6 is a perspective of an alternative embodiment of a load carrying bearing that can be used in the illustrated spray nozzle assemblies;

FIG. 6A is a front plan view of the bearing shown in FIG. 6;

FIG. 6B is a side elevational view of the bearing shown in FIG. 6A;

FIG. 6C is a transverse section of the bearing shown in FIG. 6A, taken in the plane of line 6C-6C; and FIG. 6D is a transverse section of the bearing shown in FIG. 6A, taken in the plane of line 6D-6D.

Figure 1:
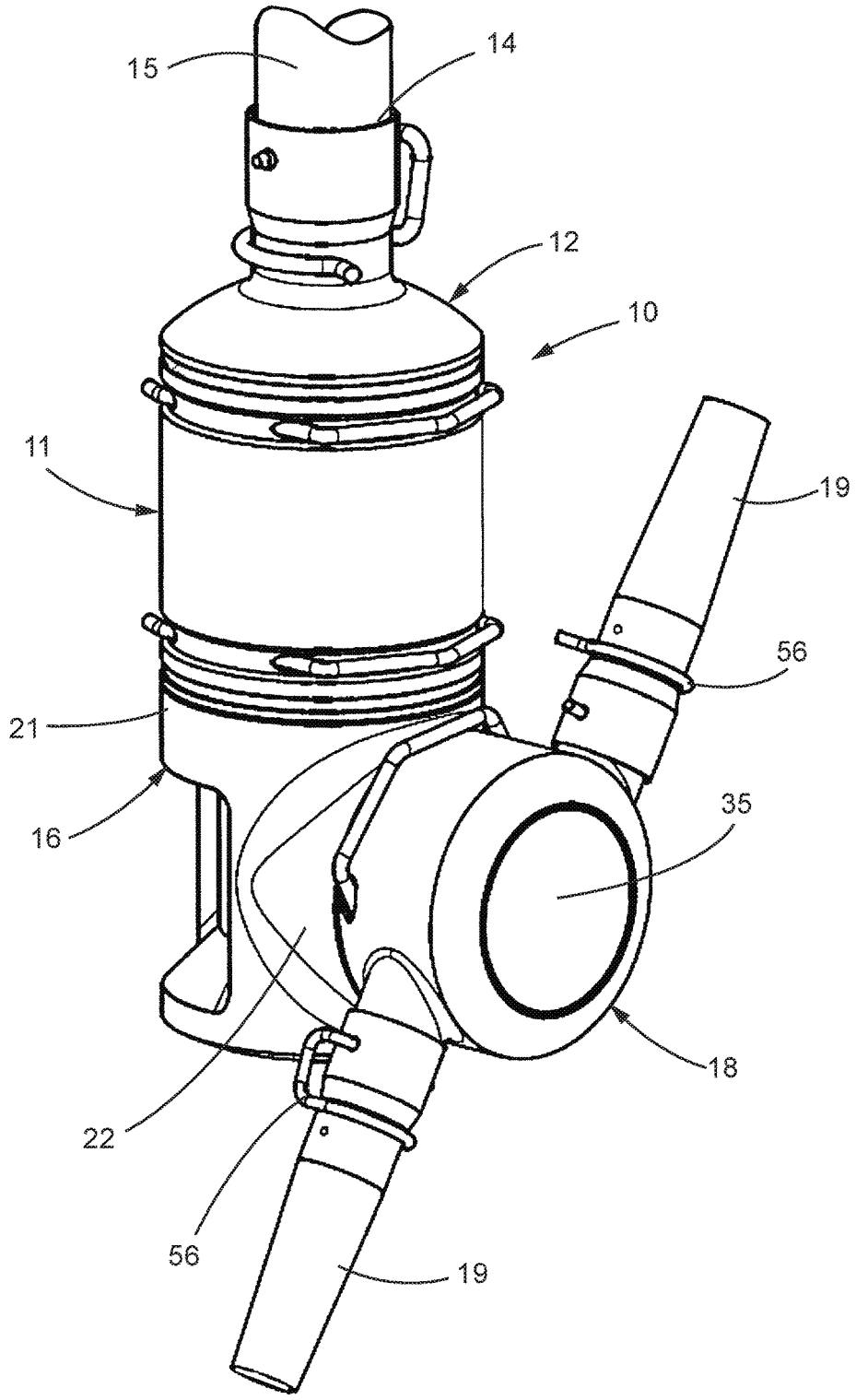
FIG. 1 is a perspective of an illustrative spray nozzle assembly in accordance with the invention.
Figure 2:
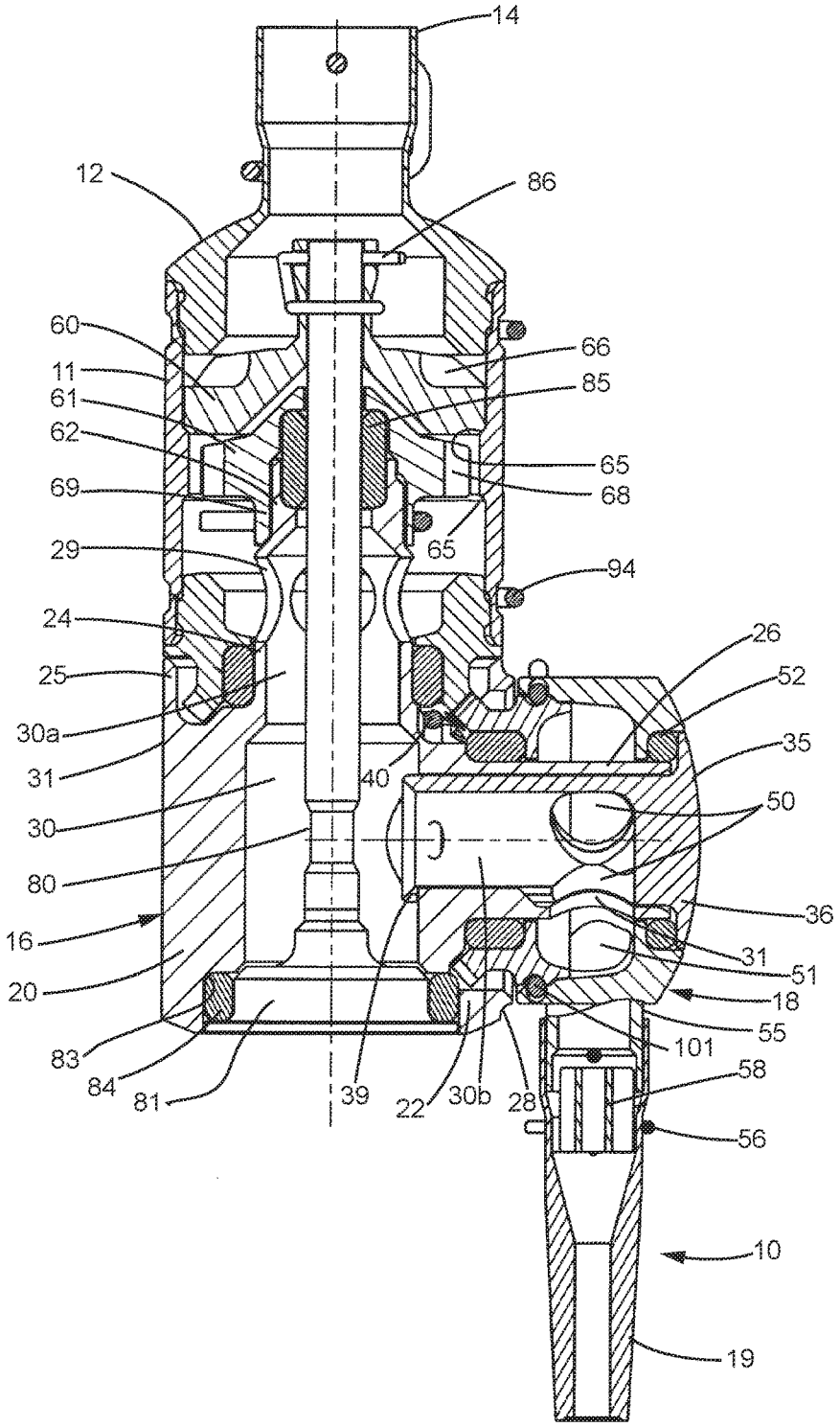
FIG. 2 is an enlarged vertical section of the spray nozzle assembly shown in FIG. 1.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DESCRIPTION OF THE PREFERRED EMBODIMENT

Referring now more particularly to the drawings, there is shown an illustrative rotary spray nozzle assembly 10 in accordance with the invention. The illustrated spray nozzle assembly 10 basically compromises a stationary housing 11, in this case cylindrical in shape, a liquid inlet cap 12 fixed to an upper end of the stationary housing 11 having an upper cylindrical liquid inlet 14 for coupling to a suitable cleaning liquid supply line 15, a rotary housing 16 supported at a lower end of the stationary housing 11 for relative rotation with respect to the stationary housing 11 about a central vertical axis of the stationary housing 11, and a nozzle hub 18 having a pair of oppositely directed liquid discharge nozzles 19 supported by said rotary housing 16 for relative rotation about an axis transverse to a rotary axis of the rotary housing 16.

In accordance with an important feature of the illustrated embodiment, components of the spray nozzle assembly 10 are free of threaded couplings and adapted for quick and easy assembly and disassembly for sanitary cleaning. In the illustrated embodiment, the rotary housing 16 has a right angle configured construction comprising a cylindrical body 20 having an upstream vertically oriented section 21 and a downstream horizontal or right angle section 22. The vertically oriented section 21 includes an upstanding generally cylindrical hub 24 surrounded by a lower vertically opening flange or lip 25 and the horizontal or right angle section 22 includes a sidewardly projecting tubular sleeve 26 surrounded at its upstream end by a horizontally opening flange or lip 28. As will become apparent, cleaning fluid directed through the spray nozzle assembly 10 from the liquid inlet 14 will pass through horizontal openings 29 the upstanding cylindrical hub 24 of the vertical section 21 for direction through a right angle passage 30 within the rotary housing 16 and exit through radial openings 31 in the right angle or horizontal tubular sleeve 26 of the rotary housing 16, upon which the nozzle hub 18 is supported for relative rotation. The right angle passage 30 in this case comprises a vertical passage section 30*a* in the vertically oriented section 21 and a horizontal passage section 30*b* in the right angle or horizontal tubular sleeve 26.

For retaining the nozzle hub 18 on the rotary housing 16, a quick disconnect coupling is provided which includes a hub cap 35 having an enlarged diameter outer end 36 positionable within a recess 38 in an outer end of the nozzle hub 18 and a smaller diameter open ended tubular section 39 extending into and through the tubular sleeve 26 of the rotary housing 16. For releasably retaining the hub cap 35 and nozzle hub 18 on the right angle tubular sleeve 26 of the rotary housing 18, a quick disconnect retaining clip 40 is provided which has a generally U-shaped configuration with a pair of depending legs 40*a* positioned through respective apertures in the rotary housing 16, which in this case when viewed from above are disposed within the diameter of the annular lip 28, into the right angle passage 30 for interaction with grooves or slots 44 (FIG. 3) in opposite sides of the tubular section 39 of the hub cap 35. The hub cap 35 is thereby retained in assembled position in the right angle sleeve 26 of the rotary housing 16, and hence, the nozzle hub 18 is retained in mounted position on the right angle sleeve 26, while permitting relative rotation of the nozzle hub 18.

The tubular section 39 of the hub cap 35 has an open upstream end for permitting communication of cleaning fluid directed through the right angle passage 30 of the rotary housing 16 into the hub cap cylindrical section 39 and through radial openings 50 therein that are maintained by the retaining clip 40 in aligned relation to the radial openings 31 in the tubular sleeve 26 of the rotary housing 16.

The nozzle hub 18 is formed with an internal annular chamber 51 surrounding the tubular sleeve 26 of the rotary housing 16 into which liquid passing through the aligned openings 31, 50 is directed and from which liquid is directed outwardly through the nozzles 19 for discharge into a tank or vessel to be cleaned. An annular bushing seal 52 is provided between the enlarged cylindrical end 36 of the hub cap 35 and the nozzle hub 18 while permitting relative rotation of the nozzle hub 18. It will be seen, therefore, that liquid directed into the radial openings 29 of the vertical section 24 of the rotary housing 16 will travel through the right angle passage 30 for direction radially outwardly through aligned apertures 50, 31 of the hub cap 35 and right angle tubular sleeve 26 of the rotary housing 16 and in turn through and discharge from the nozzles 19 of the hub 18. The hub cap 35 retains the nozzle hub 18 while allowing free rotation of the nozzle hub 18 with respect to the rotary housing 16.

To facilitate cleaning and inspection of the nozzles 19, the nozzles 19 also are removeably affixed to the nozzle hub 18 by respective quick disconnect couplings. To that end, the nozzle hub 18 has a pair of outwardly projecting tubular outlets 55 over which the nozzles 19 are respectively positioned and retained by a respective retaining clip 56 positionable through aligned apertures in the tubular outlets 55 and nozzles 19 and retained in surrounding relation to the nozzle 19. A liquid stabilizing vane 58 in this case is supported within each tubular outlet 55 for reducing turbulence and stabilizing liquid flow as it is directed to and through the respective nozzles 19.

For rotating the rotary housing 16 relative to the stationary housing 11, a fluid driven drive is provided that includes a liquid directing stator 60 mounted within the stationary housing 11 for tangentially directing liquid introduced through the inlet 14 for rotatively driving a downstream rotor 61 coupled to an upper drive sleeve or segment 62 of the cylindrical hub 24 of the rotary housing 16. The stator 60 in this case is supported on an internal annular seating ledge 65 (FIG. 3) defined by an upwardly opening counter bore in the stationary housing 11. The stator 60 in this instance is formed with a plurality of circumferentially spaced vanes for imparting a tangential component to the liquid directed from the stator 60 for impinging and driving outer veins 68 of the rotor 61 in a conventional manner.

In keeping with this embodiment, the rotor 61 is affixed to the rotary housing 16 by a quick disconnect coupling. The rotor 61 in this case has a depending annular stem 69 (FIG. 3), and the quick disconnect coupling comprises a U-shaped pin or retainer 70 having a pair of legs that are positionable through aligned apertures 71 on opposite sides of the depending stem 69 of the rotor 61 and through outer grooves 72 on opposite sides of the upwardly extending annular drive sleeve 62 of the rotary housing 16. With the pin 70 in place, rotational driving movement of the rotor 61 will rotate the rotary housing 16.

In keeping with this embodiment, the drive components of the rotary housing 16 are adapted for quick disconnect assembly and disassembly, again for facilitating easy cleaning. To this end, the rotary housing 12 and drive components thereof are supported in the stationary housing 11 by an upstanding rod or pin 80 positioned centrally through the vertical section 21 of the rotary housing 16 and into the stationary housing 11 through the rotor 61 and the stator 60. The upstanding support rod 80 has an enlarged bottom cap or end 81 that is positionable into a bottom opening 83 of the rotary housing 12 for closing the bottom opening 22. A thrust bearing 84 is interposed between the bottom cap 81 of the support rod 80 and the bottom opening 83 of the rotary housing for sealing the bottom opening 83 of the rotary housing 16while facilitating relative rotation with respect to the support rod 80 and its bottom cap 81. An elongated annular bushing 85 also is interposed between the rotor 61 and support rod 80 for facilitating relative rotation, and a cylindrical bushing 87 is disposed between the stationary and rotary housings 11, 16.

For securing the upper end of the support rod 80 to the stator 60, the stator 60 has an integral upwardly extending cylindrical stem 83 through which the upper end of the support rod 80 extends. The upper end of the support rod 80 and the stator stem 82 have apertures 84, 85, respectively, that can be secured in aligned relation by a retainer clip 86 having a leg or pin 86*a* positioned through the apertures 84, 85 and a wrap around section 86*b* about the stem 82.

In assembled condition, it has been found that with the rod 80 supporting the weight of the rotary housing 16 and nozzle hub 18, together with the pressure of the liquid directed into the spray nozzle assembly, the stator 60 and support rod 80 are retained on the annular seating ledge 65 of the stationary housing 11 without relative rotation and without additional fastening means. Alternatively, interlocking lugs could be provided between the stator 60 and the stationary housing 11.

In carrying out a further feature of this embodiment, a rotary drive for the nozzle hub 18 is provided that includes a pair of separate annular bevel gear rings 90, 91 respectively secured to the rotary housing 16 and nozzle hub 18 by respective disconnect couplings. The annular bevel gear ring 90 include a lower annular array of bevel gears 90*a* and an upper annular mounting rim 92 of reduced diameter for positioning within the bottom of the stationary cylindrical housing 11. For releasably securing the bevel gear 90 to the stationary housing 11 a U-shaped retainer clip 94 is provided which has legs positioned through aligned apertures 95 adjacent the bottom of the stationary housing 11 and external slots 96 (FIG. 3) on opposite sides of the rim 92 of the bevel gear ring 90. For facilitating proper positioning of the rim 92 of the bevel gear ring 90 within the stationary housing 11 with the apertures 95 and slots 96 in aligned relation, the annular rim 92 may be provided with one or more protruding nibs that are positioned in respective alignment recesses on an inner side of the stationary housing 11 extending axially upwardly from the bottom. With the bevel gear ring 90 affixed within the stationary housing 11, the downward protruding bevel gears 90*a* are protectively disposed within the upper opening annular flange 25 of the rotary housing 16.

The nozzle hub bevel gear ring 91 includes a mounting rim 100 positioned within an upstream end of the nozzle hub 18 and an annular array of bevel gears 91*a* facing the stationary housing 11. For interaction with the bevel gears 90*a* of the bevel gear ring 90 of the stationary housing 11 for securing the bevel gear ring 91 to the nozzle hub 16 with a quick disconnect coupling a U-shaped retainer 101 again is provided having legs which are positionable through aligned apertures 102 in the nozzle hub 18 and opposed grooves 104 in opposite sides of the mounting rim 100 of the bevel gear ring 91. An elongated annular sealing and bearing 105 is interposed between the bevel gear ring 91 and the tubular sleeve 26 of the rotary housing 16 for sealing the upstream end of the nozzle hub 18 while facilitating relative rotation of the nozzle hub 18 with respect to the rotary housing 16. The bevel gears 91*a* of the bevel gear ring 91 are substantially contained within the annular flange or lip 28 of the rotary housing 16.

Figure 3:
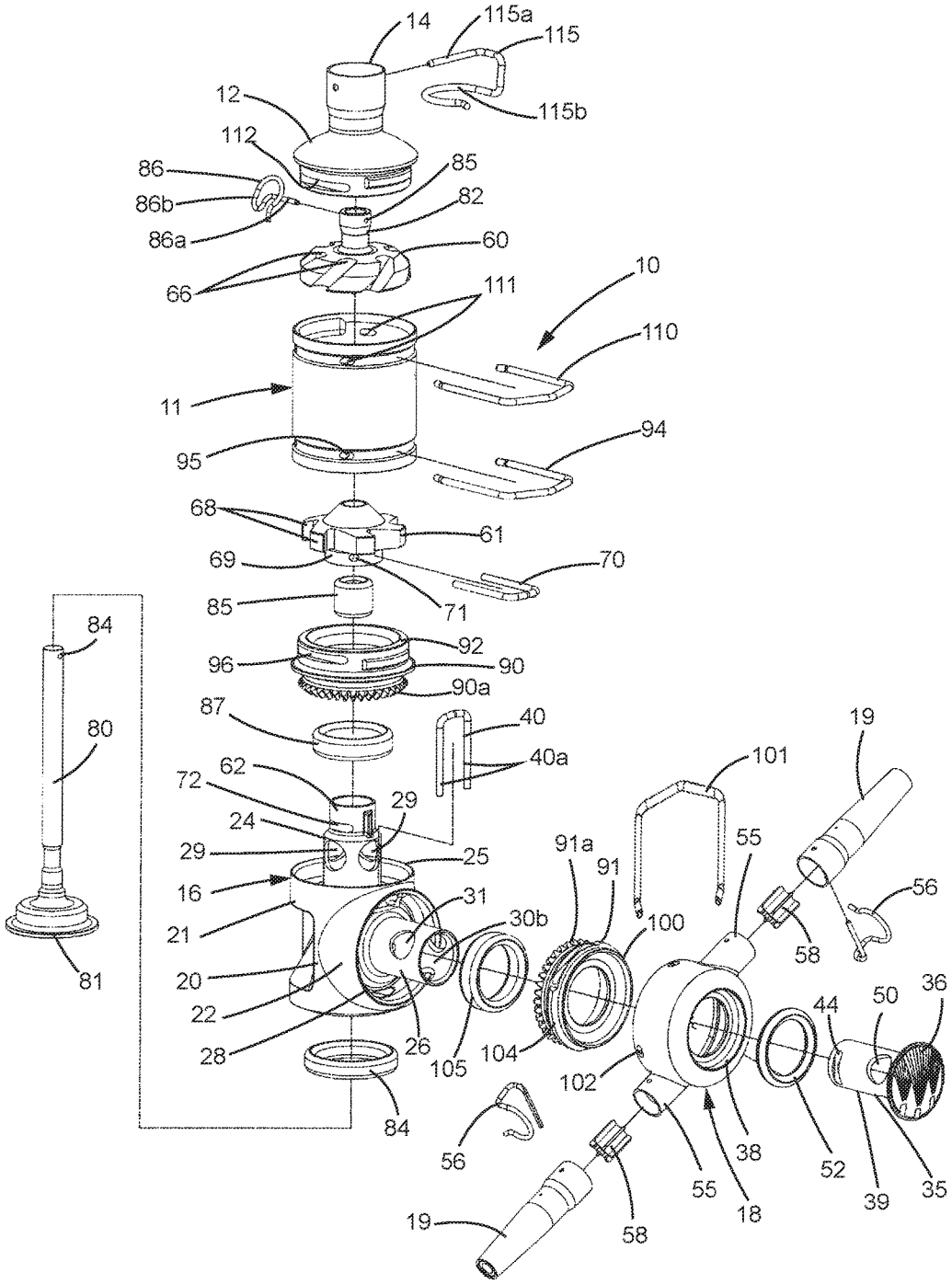
FIG. 3 is an exploded view of the illustrated spray nozzle assembly.

To facilitate access to internal components of the spray nozzle assembly 10 for quick disconnect disassembly and cleaning, in further keeping with this embodiment, the liquid inlet cap 12 is secured to the stationary housing 11 by a quick disconnect coupling which includes a U-shaped clip or retainer 110 having legs that are positionable through aligned apertures 111 in an upper end of the stationary housing 11 and through side retention slots 112 in diametrically opposed sides of the liquid inlet cap 12 (FIG. 3). With the legs of the retaining clip 110 fixed within an upper end of the stationary housing 11 and disposed within the opposed slots 112, the liquid inlet cap 12 is securely fixed to an upper end of the stationary housing 11, yet is easily removable from the stationary housing 11 by withdrawal of the clip 110 for permitting access to the interior of the assembly. The retaining clip 86 for the rotary housing support rod 80 then is easily removable to permit withdrawal of the rotary housing 16 and nozzle hub 18 from the stationary housing 11 for easy disassembly and cleaning by virtue of the quick disconnect couplings of the drive components as described above. The liquid inlet 14 of the cap 12 in this case are secured to the liquid supply line 15 by a quick disconnect clip 115 having a horizontal leg 115*a* positionable through lined apertures in the upper end of the tubular member and the liquid supply line and a wrap around retaining portion 115*b* positioned about an retained within a reduced diameter section of the tubular inlet 14.

Pursuant to still a further feature of this embodiment, it will be appreciated by one skilled in the art that the stationary housing 11 basically is an easily manufacturable cylindrical tubular member. Moreover, by forming a counter bore and stator seating surface 65 in opposite ends of the tubular stationary housing 11, the stationary housing may be assembled without regard to which end is on a top or bottom side.

Figure 4:
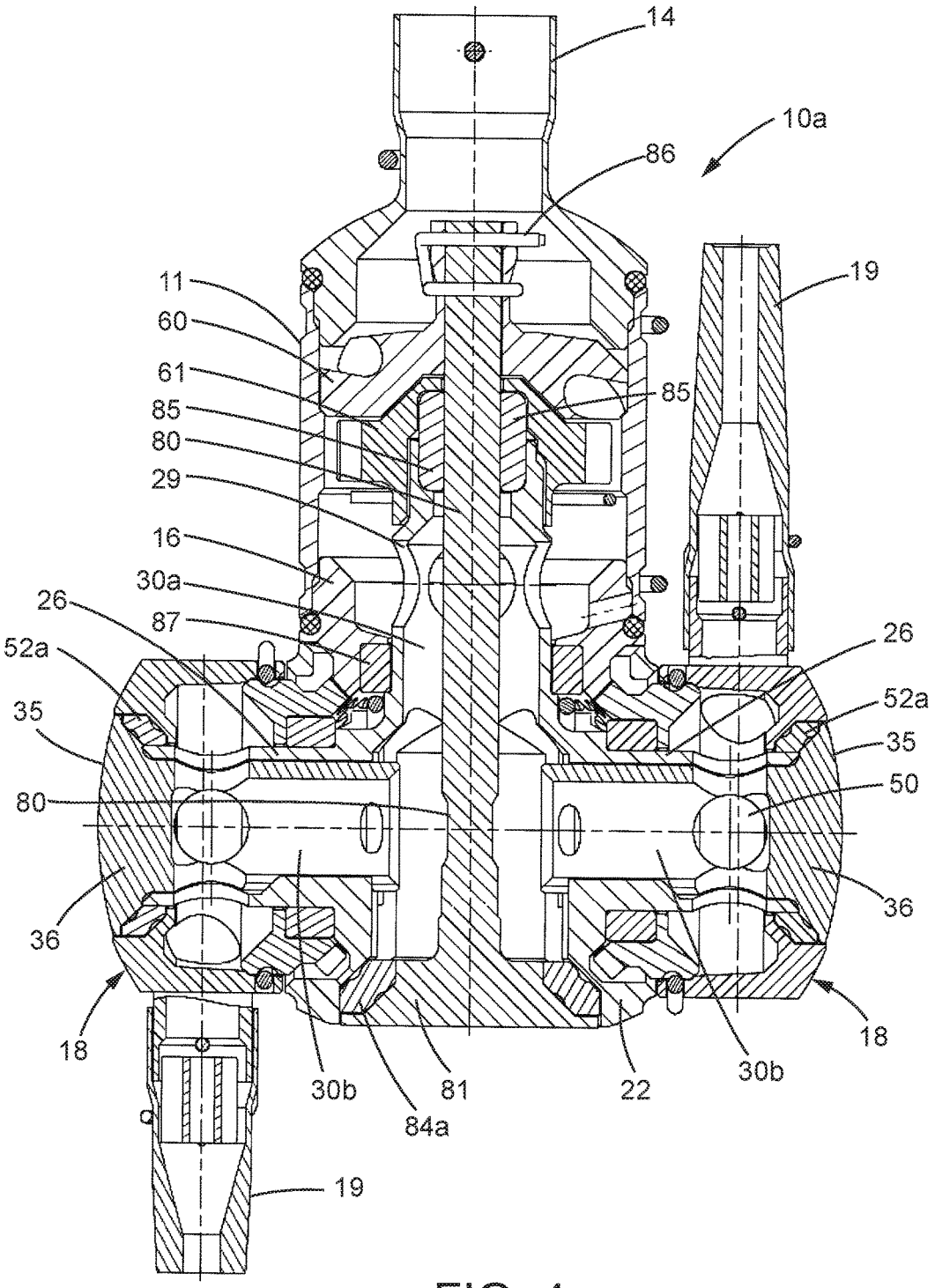
FIG. 4 is a vertical section of an alternative embodiment of a spray nozzle assembly in accordance with the invention.

With reference to FIG. 4, there is shown another embodiment of a rotary tank cleaning spray nozzle assembly 10*a* having load carrying bearings that are less susceptible to over stressing and wear during operation of the rotary spray nozzle assembly. Similar parts to those described above have been given similar reference numerals. The rotary spray nozzle assembly 10*a* has a stationary housing 11 with a liquid inlet cap 12 fixed at an upper end of the stationary housing 11 and a rotary housing 16*a* held at a lower end of the stationary housing 11 by a support rod 80 secured at its upper end to the stator 60 fixed similar to that describe above.

In this embodiment, the rotary housing 16*a* carries and rotatably supports a pair of diametrically opposed nozzle support hubs 18 such that during rotary operation of the spray nozzle assembly 10*a* opposing stresses on the structure and bearings of the spray nozzle assembly are minimized. To this end, the hubs 18 and spray nozzles 19, which are similar to those described above, are mounted on diametrically opposed sides of the rotary housing 16*a*. At the outset, it will be seen that during rotation of the rotary housing 16, radial forces on bearings and bushings 84*a*, 85 and 87 disposed concentric to the support rod 80 and rotary axis of the rotary housing 16 tend to counter each other so as to reduce bearing stress and wear.

In further carrying out this embodiment, load carrying bearings of the spray nozzle assembly 10*a* that are further or otherwise subjected to relatively high stresses during operation of the spray nozzle assembly have a design and construction that is less susceptible to wear, failure, and costly maintenance. By way of example, it can be seen that the annular bearing 84*a* between the end 81 of the support rod 80 and the underside of the rotary housing 16 supports the considerable weight of the rotary housing 16, both rotary hubs 18, and the spray nozzles 19, as well as forces generated by pressurized liquid directed through the rotor housing, and by reason of such loading on the bearing 84*a*, during operation of the spray nozzle assembly 10*a* the bearing can incur relatively high stresses. To accommodate that loading, the bearing 84*a* has a construction that exhibits particularly low frictional resistance under loading during operation of the spray nozzle assembly 10*a*.

Figure 5:
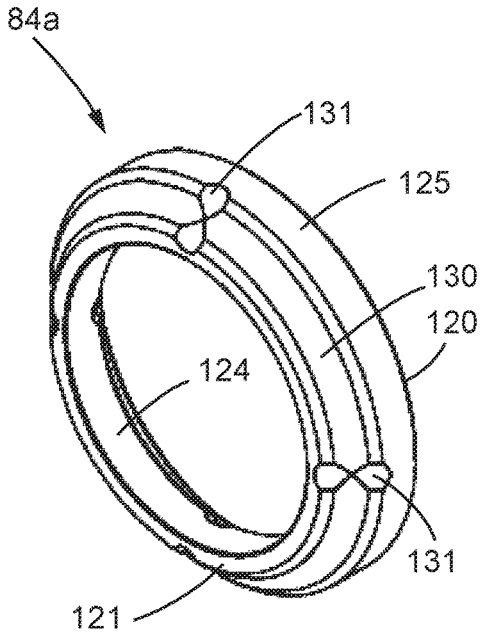
FIG. 5 is an enlarged perspective of an embodiment of a bearing that can be used in the illustrated spray nozzle assemblies.
Figure 5A:
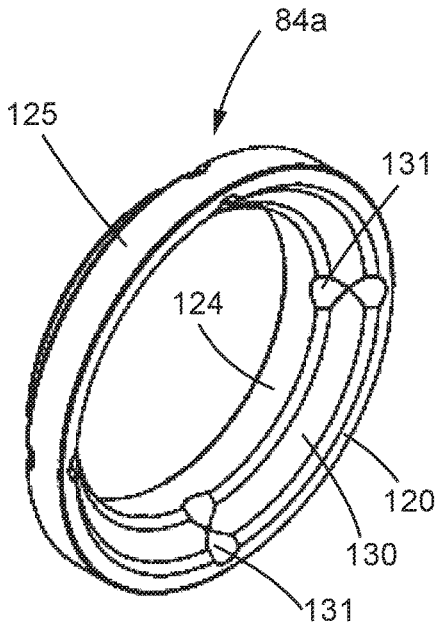
FIG. 5A is a rear perspective of the load carrying bearing shown in FIG. 5.
Figure 5B:
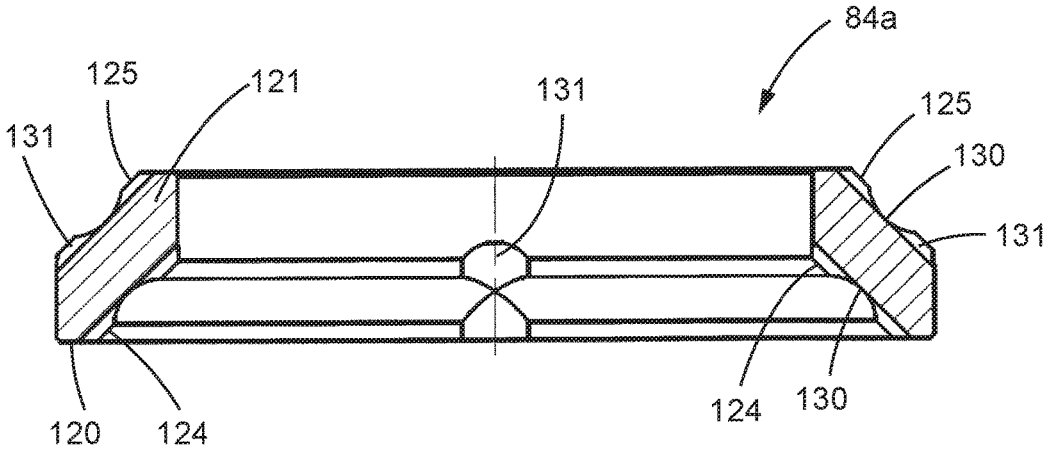
FIG. 5B is a vertical section of the bearing shown is FIGS. 5.

The illustrated bearing 84*a*, as best depicted in FIGS. 5-5B, has a one piece plastic frustoconical construction with downstream and upstream end faces 120, 121 perpendicular to a central axis of the rotary housing 16 and support rod 80 and tapered inner and outer side bearing surfaces 124, 125 oriented at an acute angle to the central axis of the rotary housing and support rod, in this case at an angle of about 45 degrees. The tapered side bearing side surfaces 124, 125 in this instance are mounted between complimentarily angled bearing surfaces of the support rod bottom cap 81 and the rotary housing 16. An outer peripheral lip of the bottom cap 81 in this case encompasses the large diameter end face 120 of the bearing. In such arrangement, it can be seen that the weight loading of the rotary housing 16, hub 18, and nozzles 19 on the bearing 84*a* act on the tapered bearing surfaces 124, 125, in this case 45 degrees to the central axis, diverting stresses both transversely and axially for minimizing axial loading on the bearing 84*a* and frictional forces incurred by relative rotation of the rotary housing 16 on the support rod 80.

In keeping with this embodiment, the tapered inner and outer bearing surfaces 124, 125 have fluid passageways and chambers for receiving cleaning fluid directed through the spray nozzle assembly, which acts as a secondary bearing surface for further relieving frictional loading on the bearing. The passages and chambers further enable drainage of cleaning fluid as required for sanitary operation and for cleaning of the bearing surfaces. In the illustrated embodiment, the inner and outer bearing surfaces 124, 125 each are formed with a respective annular or radial chamber or recess 130, as well as a plurality of linear slots or recesses 131 communicating through the radial chambers between opposite axial ends of the frustoconical bearing surfaces 124, 125. During operation of the spray nozzle assembly 100, it will be seen that a portion of cleaning fluid directed through the spray nozzle assembly, and particularly through the passageways 30*a*, 30*b* of the rotary housing 16, will migrate through the linear passageways 131 to the radial chambers 130 and then drain out from the bottom cap 81 of the support rod 80. The cleaning fluid in the radial chambers 130 on both inner and outer sides of the bearings have been unexpectedly found to act as a secondary bearing surfaces, further relieving axial loading on the surfaces 124, 125. The bearing 84*a* preferably is made of a hard, wear and chemical resistant plastic material that itself exhibits low friction under loading.

A bearing 52*a*, similar to 84*a*, in this case is interposed between the end 36 of each hub cap 35 and its associated rotary hub 18. In operation of the spray nozzle assembly 10*a*, relatively high stresses can occur between the end cap 35 and the rotary hub 18 due to the upstream end of the end cap 35 being fixed to the rotary housing by the retaining clip 40 and pressurized liquid directed through the rotary housing 16 and end cap 35 causing the nozzle carrying rotary hub 18 to be urged against the bearing 52*a* with relatively high force. The bearing 52*a*, similar to the bearing 84*a*, is made of hard plastic material and formed with linear passages and radial chambers 130, 131 that receive cleaning fluid that relieves loading on the bearing surfaces during operation of the spray nozzle assembly.

With reference to FIGS. 6-6D, there is shown an alternative embodiment of bearing 84*b*, that can be used at high bearing load locations in the illustrated spray nozzle assemblies 10, 10*a*, such as described in connection with the bearings 84*a*, 52*a*. The bearing 84*b* in this case is a roller bearing comprising a one piece frustoconical configured cage 140, preferably made of plastic, and a plurality of rollers 141, preferably made of stainless steel, mounted for relative rotational movement within the annular cage 140. The rollers 141 in this case are straight cylindrical rollers, having axial cylindrical mounting stems 142 (FIG. 6C) at opposite ends. Alternatively, it will be understood that he rollers could be tapered.

The cage 140 has a frustoconical shape, with outer and inner side surfaces 145, 146 that tapered at an angle of about 45 degrees to a central axis, and which is formed with a plurality of circumferentially spaced cavities or openings 149 each for receiving a respective roller 141. For mounting the rollers 141, the axial ends of the cage 140 each have inwardly tapered walls 150, 151 formed with an annular recesses 154 corresponding in diameter to the diameter of the roller bearing stem 142 and a slightly smaller width entrance passageway section 155 (FIG. 6A). The rollers 141 can be assembled into the cage by press fitting the stems 147 into the respective annular recesses 154 which captively retains the roller 141 in mounted position. The rollers 141 have a diameter such that they protrude through the respective cavities 149 on inner and outer sides of the cage 140 and are angled similarly to the cage for providing roller bearing support between the end cap 81 of the support rod 80 and the rotary housing 16. A similar bearing 52*b* can be used between the hub cap 35 and the rotor hub 35, or other high load locations between relative moving components of the spray nozzle assembly. With the rollers 140 oriented at an angle to the axis of rotation, they again accommodate radial, axial, or combination loading. The cavities formed bearing cage 140 also facilitates the flow of cleaning fluid through the cage 140 and around the rollers 141 for bearing cleaning, lubrication, and draining. The rollers 141 further can be easily removed and reinstalled within the cage 140 for cleaning, maintenance, or replacement.

From the foregoing, it can be seen that a rotary tank cleaning spray nozzle assembly is provided which is adapted for quick and easy assembly and disassembly for facilitating frequent cleaning. This may be accomplished by untrained personnel and the easily disassembled components of the spray nozzle assembly, being free of threaded connection, lend themselves to thorough sanitary cleaning. The individual bevel gear rings of the stationary housing and nozzle hub further lend themselves to easier manufacture, repair or replacement, and cleaning. The spray nozzle assemblies further may have self lubricating and draining load carrying bearings for minimizing stress and wear during operation of the spray nozzle assembly.

The invention claimed is:

1. A rotary tank cleaning spray nozzle assembly comprising:

a stationary outer housing;

a liquid inlet disposed at an upper end of said stationary housing for connection to a liquid supply and for direction of liquid into said stationary housing;

a rotary housing disposed below said stationary housing for rotation relative to said stationary housing about a central axis of said stationary housing;

a nozzle hub having at least one liquid spray nozzle, said nozzle hub being mounted on said rotary housing for rotation relative to said rotary housing about an axis transverse to the central axis of said stationary housing;

a fluid driven drive mechanism including a stator mounted within said stationary housing for tangentially directing liquid passing through said housing, a rotor associated with said rotary housing for rotation as an incident to the tangential direction of liquid from said stator for rotating said rotary housing relative to said stationary housing;

said rotary housing and nozzle hub having cooperating gears for rotating said nozzle hub relative to said rotary housing as an incident to rotation of said rotary housing with respect to said stationary housing; and a support rod having a bottom support for supporting said rotary housing for relative rotation and extending upwardly through the rotary housing into the stationary housing and through said rotor and stator, and a releaseable support rod retainer engageable with an upper end of said support rod for supporting the support rod against rotation and with the support rod retaining the rotary housing in operative relation to the stationary housing for relative rotation.

2. The rotary tank cleaning spray nozzle assembly of claim 1 in which said support rod retainer is selectively removable from the support rod to permit removal of the support rod, rotary housing, and nozzle hub from an underside of the stationary housing.

3. The rotary tank cleaning spray nozzle assembly of claim 2 in which said support rod supports the weight of the rotary housing, nozzle hub, and said at least one spray nozzle.

4. The rotary tank cleaning spray nozzle assembly of claim 3 in which said support rod retainer releasably secures the upper end of said support rod to said stator.

5. The rotary tank cleaning spray nozzle assembly of claim 1 in which said stationary housing comprises a cylindrical outer body, and said liquid inlet being smaller in diameter than said stationary housing outer cylindrical body.

6. The rotary tank cleaning spray nozzle assembly of claim 5 in which said liquid inlet is part of an end cap, a releasable cap retainer for securing said end cap to an upper end of the cylindrical body, and said cap retainer being removable to permit removal of said housing end cap and access into said cylindrical body from an upper end thereof for enabling release of said support rod retainer and removal of the rotary housing and hub from an underside of the cylindrical body.

7. The rotary tank cleaning spray nozzle assembly of claim 5 in which said cylindrical body is formed with a first counter bore adjacent one end thereof that defines a first ledge for supporting said stator, and said cylindrical body being formed with a second counter bore adjacent an end of the cylindrical body opposite said one end for defining a second ledge similar to said first ledge such that the cylindrical body may be assembled in the spray nozzle assembly with either the first or second ledge adjacent an upper end thereof.

8. The rotary tank cleaning spray nozzle assembly of claim 1 in which said rotary housing is releasably connected to said cylindrical body by a first non-threaded retainer, said hub is releasably connected to said rotary housing by a second non-threaded releasable retainer, said rotor is releasably connected to said rotary housing by a third non-threaded releasable retainer.

9. The rotary tank cleaning spray nozzle assembly of claim 1 in which said stator has an upwardly extending cylindrical stem through which an upper end of said support rod extends, and said support rod retainer extends through the upper end of said support rod and cylindrical stem for supporting said support rod and preventing relative rotation of said support rod and stator.

10. The rotary tank cleaning spray nozzle assembly of claim 1 in which said rotary housing supports and as incident to rotation rotatably drives two of said of nozzle hubs each having at least one said spray nozzle, and said nozzle hubs being disposed on diametrically opposed sides of said rotary housing.

11. The rotary tank cleaning spray nozzle assembly of claim 1 in which said rotary housing and nozzle hub cooperating gears are defined by separate gear rings each having respective bevel gears, one of said gear rings being releasably coupled to an underside of the stationary housing by a releasable retainer, and the other of said gear rings being releasably coupled to the nozzle hub by a releasable retainer.

12. The rotary tank cleaning spray nozzle assembly of claim 1 including an annular bearing between the bottom of said support rod and an underside of said rotary housing, said annular bearing defining liquid passages communicating with the rotary housing for permitting a portion of liquid directed through said rotary housing to migrate between said annular bearing and said rotary housing for facilitating low friction relative movement of the rotary housing with respect to said annular bearing and support rod.

13. The rotary tank cleaning spray nozzle assembly of claim 12 in which said annular bearing is made of a one piece hard plastic material and has a frustoconical shape defining inner and outer bearing surfaces oriented at an acute angle to the axis of rotation of said rotary housing.

14. The rotary tank cleaning spray nozzle assembly of claim 13 in which said bearing surfaces each is formed with an annular radial liquid receiving chamber and a plurality of linear grooves communicating through said chambers between axial ends of the bearing.

15. The rotary tank cleaning spray nozzle assembly of claim 13 in which said bearing includes a one piece annular plastic cage formed with a plurality of openings, and a plurality of rollers each releasably mounted within respective opening with sides of the rollers protruding from opposite sides of the opening for defining rolling bearing surfaces between said support rod end and said rotary housing.

16. The rotary tank cleaning spray nozzle assembly of claim 15 in which said cage has a frustoconical configuration, and said rollers are supported within said cage at an acute angle to the rotary axis of the rotary housing.

* * * * *